US007786960B2

(12) United States Patent
Jung et al.

(10) Patent No.: US 7,786,960 B2
(45) Date of Patent: Aug. 31, 2010

(54) LIQUID CRYSTAL DISPLAY AND DRIVING METHOD THEREOF

(75) Inventors: Byung Mu Jung, Seokjeok-myeon (KR); Pan Youl Kim, Gumi-si (KR)

(73) Assignee: LG. Display Co., Ltd., Seoul (KR)

( * ) Notice: Subject to any disclaimer, the term of this patent is extended or adjusted under 35 U.S.C. 154(b) by 1436 days.

(21) Appl. No.: 11/159,483

(22) Filed: Jun. 23, 2005

(65) Prior Publication Data

US 2006/0001643 A1 Jan. 5, 2006

(30) Foreign Application Priority Data

Jun. 30, 2004 (KR) ..... 10-2004-0049925

(51) Int. Cl.
*G09G 3/36* (2006.01)

(52) U.S. Cl. ..... 345/87

(58) Field of Classification Search ..... 345/87, 345/58

See application file for complete search history.

(56) References Cited

U.S. PATENT DOCUMENTS 5,434,599 A * 7/1995 Hirai et al. ..... 345/100
5,646,643 A 7/1997 Hirai et al.
5,841,410 A * 11/1998 Oda et al. ..... 345/58
2001/0011984 A1* 8/2001 Hong ..... 345/92
2002/0024484 A1* 2/2002 Lee et al. ..... 345/87
2003/0117353 A1* 6/2003 Moon ..... 345/87
2003/0117356 A1 6/2003 Moon et al.
2003/0117566 A1* 6/2003 Park ..... 349/149
2003/0117567 A1* 6/2003 Jung et al. ..... 349/149
2003/0151713 A1* 8/2003 Aoki ..... 349/149
2004/0017535 A1* 1/2004 Ko et al. ..... 349/150
2004/0145552 A1* 7/2004 Song et al. ..... 345/87
2004/0263447 A1* 12/2004 Hong et al. ..... 345/87
2004/0263452 A1* 12/2004 Kim ..... 345/87
2005/0083474 A1* 4/2005 Park ..... 349/151
2005/0088391 A1* 4/2005 Kim ..... 345/94
2005/0110738 A1* 5/2005 Kim et al. ..... 345/100
2005/0128417 A1* 6/2005 Song et al. ..... 349/150
2005/0156840 A1* 7/2005 Kim et al. ..... 345/87

(Continued)

FOREIGN PATENT DOCUMENTS

EP 0 374 846 6/1990

(Continued)

OTHER PUBLICATIONS

Office Action dated Nov. 29, 2006 for corresponding German Patent Application No. 10 2005 030337.4-32.
Office Action issued in corresponding Taiwanese Patent Application No. 09820432310; issued Jul. 15, 2009.

*Primary Examiner*—Chanh Nguyen
*Assistant Examiner*—Robert M Stone
(74) *Attorney, Agent, or Firm*—Brinks Hofer Gilson & Lione

(57) ABSTRACT

A liquid crystal display device includes an integrated circuit, a signal line, an inspection line and a signal generator. The integrated circuit drives a liquid crystal display panel. The signal line applies a driving signal to the integrated circuit. The inspection line detects the driving signal inputted to the integrated circuit. The signal generator supplies a compensation signal corresponding to the detected driving signal from the inspection line.

16 Claims, 5 Drawing Sheets

U.S. PATENT DOCUMENTS

| | | | | |
|---|---|---|---|---|
| 2005/0212735 | A1* | 9/2005 | Lin | 345/87 |
| 2005/0286004 | A1* | 12/2005 | Lee | 349/148 |
| 2007/0002005 | A1* | 1/2007 | Kim et al. | 345/103 |
| 2007/0152943 | A1* | 7/2007 | Hwang et al. | 345/98 |

FOREIGN PATENT DOCUMENTS

| | | |
|---|---|---|
| JP | 05-181435 | 7/1993 |
| JP | 10123556 | 5/1998 |
| JP | 10153759 | 6/1998 |
| JP | 2000-330518 | 11/2000 |
| JP | 2001-282171 | 10/2001 |
| TW | 367479 | 8/1999 |
| TW | 583617 | 4/2004 |

* cited by examiner

LIQUID CRYSTAL DISPLAY AND DRIVING METHOD THEREOF

This application claims the benefit of Korean Patent Application No. P2004-49925 filed in Korea on Jun. 30, 2004, which is hereby incorporated by reference.

Field of the Invention

This invention relates to a liquid crystal display, and more particularly, to a liquid crystal display having an improved picture quality.

Description of the Related Art

A liquid crystal display (LCD) device controls a light transmittance of a liquid crystal using an electric field and displays a picture. The LCD device includes a liquid crystal display panel having liquid crystal cells arranged in a matrix type, and a driving circuit for driving the liquid crystal display panel. In the liquid crystal display panel, gate lines and data lines are arranged to intersect each other. A liquid crystal cell is positioned at each area defined by a gate line and a data line. A pixel electrode and a common electrode apply an electric field to each liquid crystal cell. Each pixel electrode is connected to one of data lines via a source electrode and a drain electrode of a thin film transistor. The thin film transistor operates as a switching device. A gate electrode of the thin film transistor is connected to one of the gate lines and allows a pixel voltage signal to be applied to the pixel electrode for each line.

The driving circuit includes a gate driver for driving the gate lines and a data driver for driving the data lines. The driving circuit also includes a timing controller for controlling the gate driver and the data driver and a power supply for supplying various driving voltages used in the LCD device. The timing controller controls a driving timing of the gate driver and the data driver and applies a pixel data signal to the data driver. The power supply generates driving voltages such as a common voltage VCOM, a gate high voltage VGH and a gate low voltage VGL, etc. The gate driver applies a scanning signal to the gate lines to sequentially drive the liquid crystal cells on the liquid crystal display panel line by line. The data driver applies a pixel voltage signal to a data line when the scanning signal is applied to a gate line. Accordingly, the LCD controls the light transmittance with an electric field applied between the pixel electrode and the common electrode in response to the pixel voltage signal for each liquid crystal cell. As a result, a picture is displayed.

The data driver and the gate driver are integrated into a plurality of integrated circuits (ICs). The integrated data drive ICs and gate drive ICs are mounted on a tape carrier package ("TCP"), which is in turn to be connected to the liquid crystal display panel with a tape automated bonding ("TAB") system Alternatively, the gate drive ICs and data drive ICs may be mounted onto the liquid crystal display panel with a chip on glass ("COG") system.

The drive ICs receive control signals and driving voltages that are input from an outside over signal lines. The signal lines are provided on a printed circuit board ("PCB") connected to the TCP. More specifically, the data drive ICs are connected in series to each other via signal lines provided on the data PCB. The data drive ICs commonly receive control signals and a pixel data signal from the timing controller and driving voltages from the power supply. The gate drive ICs are connected in series to the gate PCB via signal lines, and they commonly receive control signals from the timing controller and driving voltages from the power supply.

The drive ICs mounted onto the liquid crystal display panel with the COG system are connected to each other by a line on glass ("LOG") system In the LOG system, signal lines are mounted on the liquid crystal display panel, i.e., a lower glass substrate and receive control signals and driving voltages from the timing controller and the power supply.

Even when the drive ICs are connected to the liquid crystal display panel by the TAB system, the LOG system is used to eliminate the PCB. As a result, the liquid crystal display may be thinner. The LOG system may provide signal lines to the gate drive ICs on the liquid crystal display panel and may not need the gate PCB. The gate drive ICs of the TAB system are connected in series to each other over signal lines mounted onto the lower glass substrate of the liquid crystal display panel. The gate drive ICs commonly receive control signals and driving voltage signals, which are hereinafter referred to as "gate driving signals."

FIG. 1A and 1B illustrate a liquid crystal display device having no gate PCB by utilizing LOG-type signal lines. The liquid crystal display device includes a liquid crystal display panel 1, a plurality of data TCPs 8 and a data PCB 12. The plurality of data TCPs 8 is connected between the liquid crystal display panel 1 and the data PCB 12. The liquid crystal display device 100 also includes a plurality of gate TCPs 14 connected to other side of the liquid crystal display panel 1. Data drive ICs 10 are mounted on the data TCPs 8, and gate drive ICs 16 are mounted on the gate TCPs 14. In FIG. 2, the gate drive ICs 16 and the gate TCPs 14 are described in detail. A gate drive IC 16A is mounted on a gate TCP 14A. Gate drive ICs 16B~16D are also mounted on gate TCPs 14B~14D.

The liquid crystal display panel 1 includes a lower substrate 2. On the lower substrate 2, various signal lines and a thin film transistor array are provided. An upper substrate 4 includes a color filter array and a liquid crystal is injected between the lower substrate 2 and the upper substrate 4. The liquid crystal display panel 1 is provided with a picture display area 21 including liquid crystal cells provided at intersecting areas between gate lines 20 and data lines 18. At the periphery of the lower substrate 2 proximate the outer side of the picture display area 21, data pads extended from the data lines 18 and gate pads extended from the gate lines 20 are positioned. A LOG-type signal line group 26 is positioned at the periphery of the lower substrate 2. The LOG-type signal line group 26 transfers the gate driving signals to the gate drive ICs 16A to 16D (see FIG. 2).

The data TCP 8 has the data drive IC 10 mounted thereon and is provided with input pads 24 and output pads 25 electrically connected to the data drive IC 10. The input pads 24 of the data TCP 8 are electrically connected to the output pads 25 of the data PCB 12 via anisotropic conductive film ("ACF"). The ACF is a material used connecting the TCP circuits and the PCB. The ACF is also used for interconnecting the TCP circuits and the electrodes of LCD panels. The output pads 25 are electrically connected, via the ACF, to the data pads on the lower substrate 2. The first data TCP 8 is further provided with a gate driving signal transmission line group 22 which is electrically connected to the LOG-type signal line group 26 on the lower substrate 2. This gate driving signal transmission line group 22 applies gate driving signals from the timing controller and the power supply to the LOG-type signal line group 26 via the data PCB 12.

The data drive IC 10 convert digital pixel data signals into analog pixel voltage signals and applies the analog pixel voltage signals to the data lines 18 on the liquid crystal display panel. The gate TCPs 14A to 14D are provided with a gate driving signal transmission line group 28 electrically connected to the gate drive ICs 16A to 16D and output pads 30. The gate driving signal transmission line group 28 is electrically connected, via the ACF, to the LOG-type signal line group 26 on the lower substrate 2. The output pads 30 are electrically connected to the gate pads on the lower substrate 2.

The gate drive ICs 16A to 16D sequentially apply a scanning signal, i.e., a gate high voltage signal VGH to gate lines 20 in response to input control signals. Further, the gate drive ICs 16A to 16D apply a gate low voltage signal VGL to the gate lines 20 in the remaining interval other than an interval that the gate high voltage signal VGH is supplied.

The LOG-type signal line group 26 usually includes signal lines that supply direct current ("DC") voltage signals from the power supply, such as a gate high voltage signal VGH, a gate low voltage signal VGL, a common voltage signal VCOM, a ground voltage signal GND and a supply voltage signal VCC. The LOG-type signal lines also include signal lines that supply gate control signals from the timing controller, such as a gate start pulse GSP, a gate shift clock signal GSC and a gate enable signal GOE.

In FIGS. 1A, 1B and 2, the LOG-type signal line group 26 is arranged in parallel in a fine pattern at a space such as a pad portion positioned at an outer area of a picture display part 21. The LOG-type signal line group 26 is formed from a gate metal layer disposed adjacent the gate lines 20. A metal having a relatively large resistivity value is used as the gate metal. For example, AiNd may be used as the gate metal. By way of example, the resistivity value may be 0.046. Various other metals having a different resistivity are possible. As the LOG-type signal line group 26 is formed in a fine pattern within a confined area and is made from a gate metal having a relatively large resistivity value, it includes a resistance component X larger than that of the signal lines formed from a copper film at a conventional gate PCB. Further, the ACF (not shown) connecting the LOG-type signal line group 26 on the lower substrate 2 to the gate driving signal transmission line group 28 includes a predetermined connection resistance component Y. Moreover, the gate driving signal transmission line group 28 provided on the gate TCPs 14A to 14D or the chip on film (COF) includes a line resistance component Z. The ICs have a resistance that results from the components X, Y and Z. For example, such resistance may correspond to X+2Y+2Z between the neighboring ICs.

The resistance components are in proportion to a line length. The resistance values increase as the ICs are longitudinally extended from the data PCB 12, thereby causing attenuation of a signal supplied via the LOG-type signal line group 26. Furthermore, the common voltage VCOM, which is a standard value for the gate driving signals is distorted due to the resistance values. As a result, the quality of a picture displayed on the picture display part 21 deteriorates.

As shown in FIG. 2, the LOG-type signal line group 26 includes first to fourth LOG-type signal lines LOG1 to LOG4 connected between the first data TCP 8 and the gate TCPs 14A to 14D. The LOG-type signal lines LOG1 to LOG4 have line resistance values a, b, c and d. The line resistance values a, b, c and d are proportional to line lengths and are connected in series to one another via the gate TCPs 14A to 14D.

The line resistance values a, b, c and d result in a different common voltage VCOM for each gate drive IC 16A to 16D. For the gate drive IC 16A mounted on the first gate TCP 14A, a first common voltage VCOM1 is supplied. The first common voltage VCOM1 is a voltage-drop in proportion to the first line resistance value "a" of the first LOG-type signal line LOG1. The first common voltage VCOM1 is supplied, via the first gate drive IC 16A, to the gate lines of a first horizontal line block A.

For the gate drive IC 16B mounted on the second gate TCP 14B, a second common voltage VCOM2 is applied. The second common voltage VCOM2 is a voltage-drop in proportion to the second line resistance value "a+b" of the first LOG-type signal line LOG1 and the second LOG-type signal line LOG2 connected in series to each other. The second common voltage VCOM2 is supplied, via the second gate drive IC 16B, to the gate lines of a second horizontal line block B.

Likewise, a third common voltage VCOM3 for the gate drive IC 16C is a voltage-drop in proportion to the third line resistance value "a+b+c" and is supplied, via the third gate drive IC 16C, to the gate lines of a third horizontal line block C. A fourth common voltage VCOM4 for the gate drive IC 16D is a voltage drop in proportion to the resistance value "a+b+c+d" and is supplied to a fourth horizontal line block D.

The common voltages VCOM1 to VCOM4 differ from one another due to the resistance value. From the first gate drive IC 16A to the fourth gate drive IC 16D, the line resistance values a, b, c and d of the LOG-type signal lines LOG1 to LOG4 increase, thereby causing VCOM1 to VCOM4 to be different. Specifically, the common voltages applied to the horizontal line blocks A to D have a relationship of VCOM1>VCOM2>VCOM3>VCOM4. Application of different common voltages may result in a non-uniformity of a brightness among the horizontal line blocks A to D ICs. The non-uniformity of the brightness among the horizontal line blocks A to D may lead to a cross line effect that causes the picture field to be viewed divisionally. Accordingly, the picture quality may be deteriorated.

SUMMARY OF THE INVENTION

By way of introduction only, in one embodiment, a liquid crystal display device includes at least two integrated circuits for driving a liquid crystal display panel; a first signal line for applying the integrated circuit to a driving signal; a second signal line for detecting said driving signals inputted, via the first signal line, to the integrated circuits; and a signal generator for supplying a compensation signal corresponding to said detected driving signal from the second signal line.

A method of driving a liquid crystal display device includes the steps of applying a driving signal, via a first signal line, to at least two integrated circuits for driving a liquid crystal display panel; detecting said driving signals inputted, via the first signal line, to the integrated circuits using a second signal line; and generating a compensation signal corresponding to said detected driving signals from the second signal line to apply the compensation signal to the first signal line.

BRIEF DESCRIPTION OF THE DRAWINGS

The following detailed description of the embodiments of the invention with reference the accompanying drawings, in which.

DETAILED DESCRIPTION OF THE PREFERRED EMBODIMENT

Figure 1A:
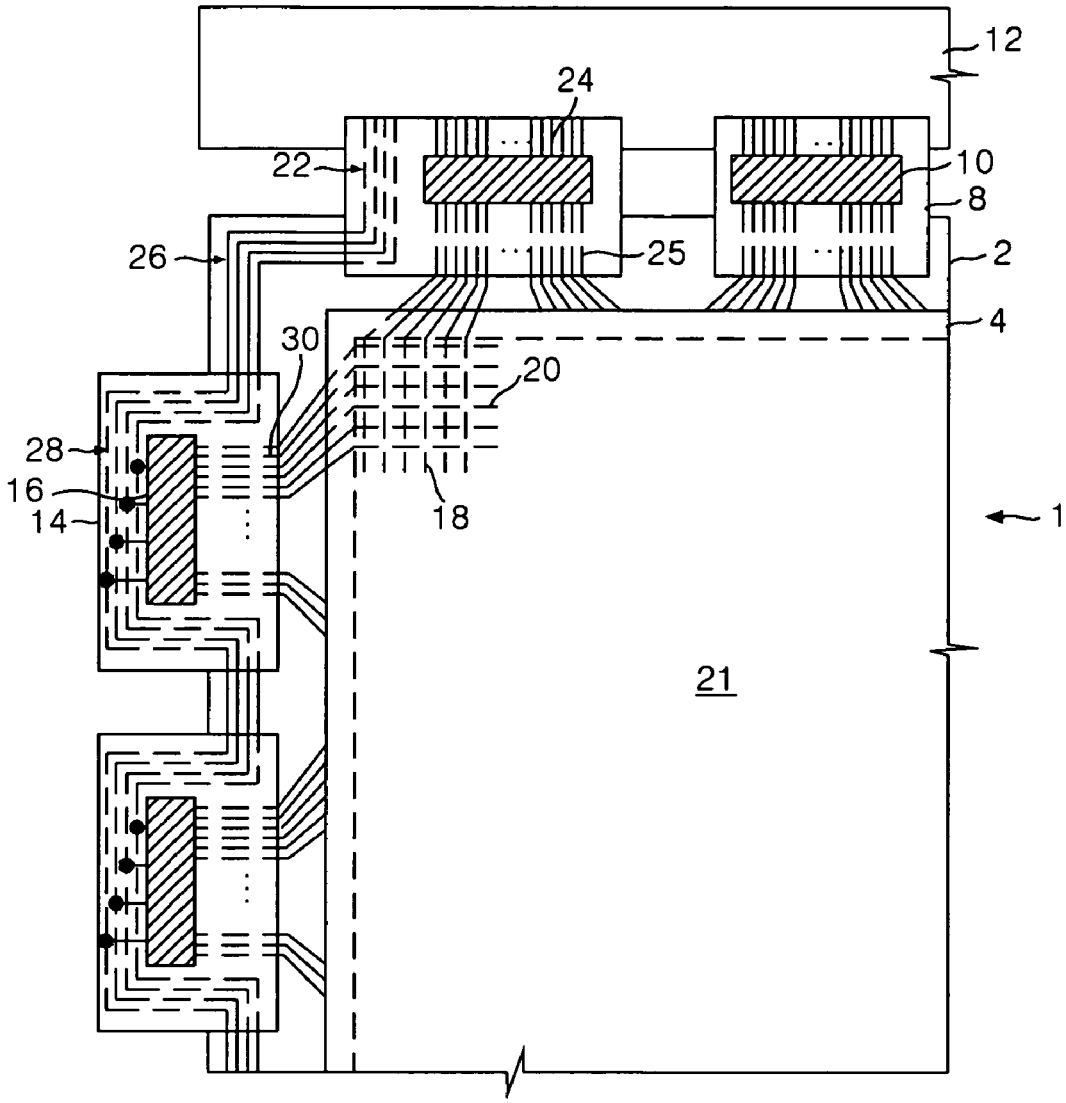
FIG.1A RELATED ART
FIG. 1A is a schematic plan view showing a configuration of a related art liquid crystal display device.
Figure 1B:
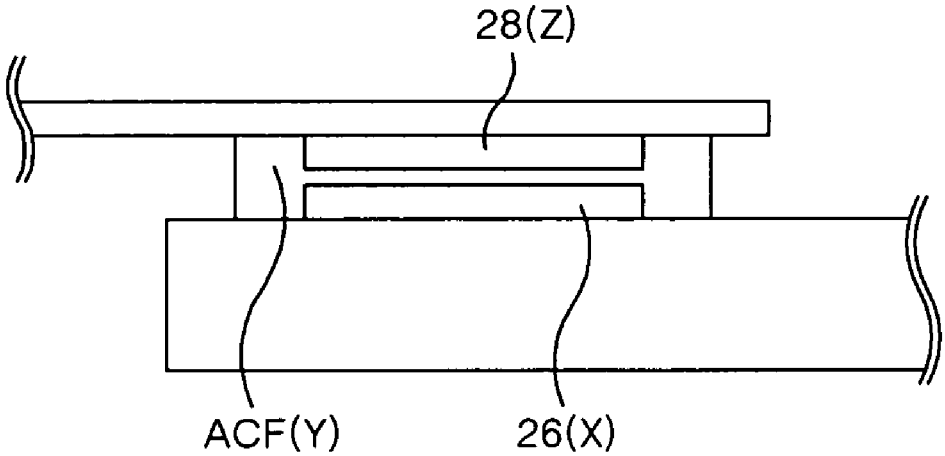
FIG. 1B RELATED ART
FIG. 1B is a sectional diagram representing the resistance components of X, Y and Z.
Figure 2:
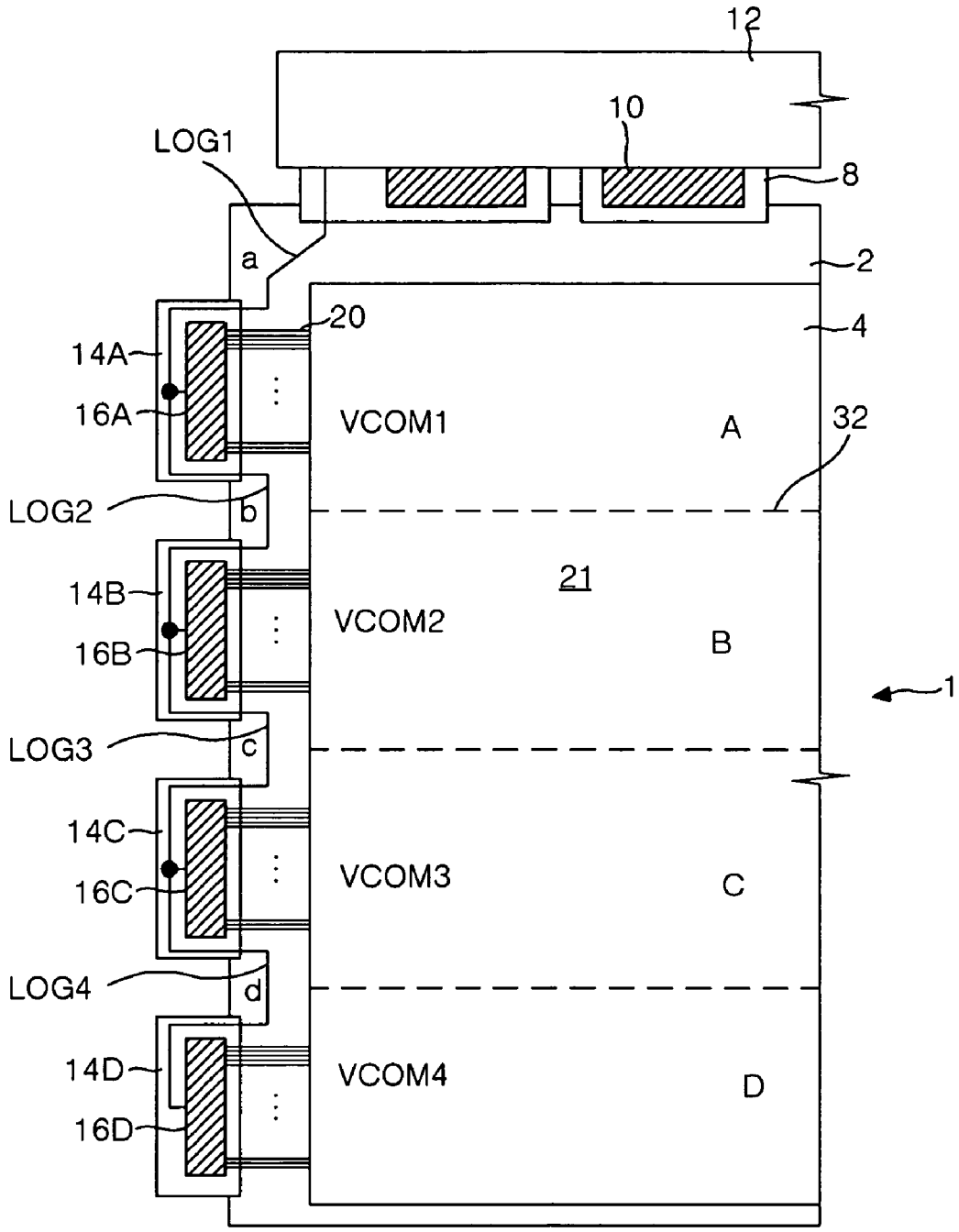
FIG.2 RELATED ART
FIG. 2 illustrates horizontal line blocks and a line resistance of the signal line group shown in FIG. 1.
Figure 3:
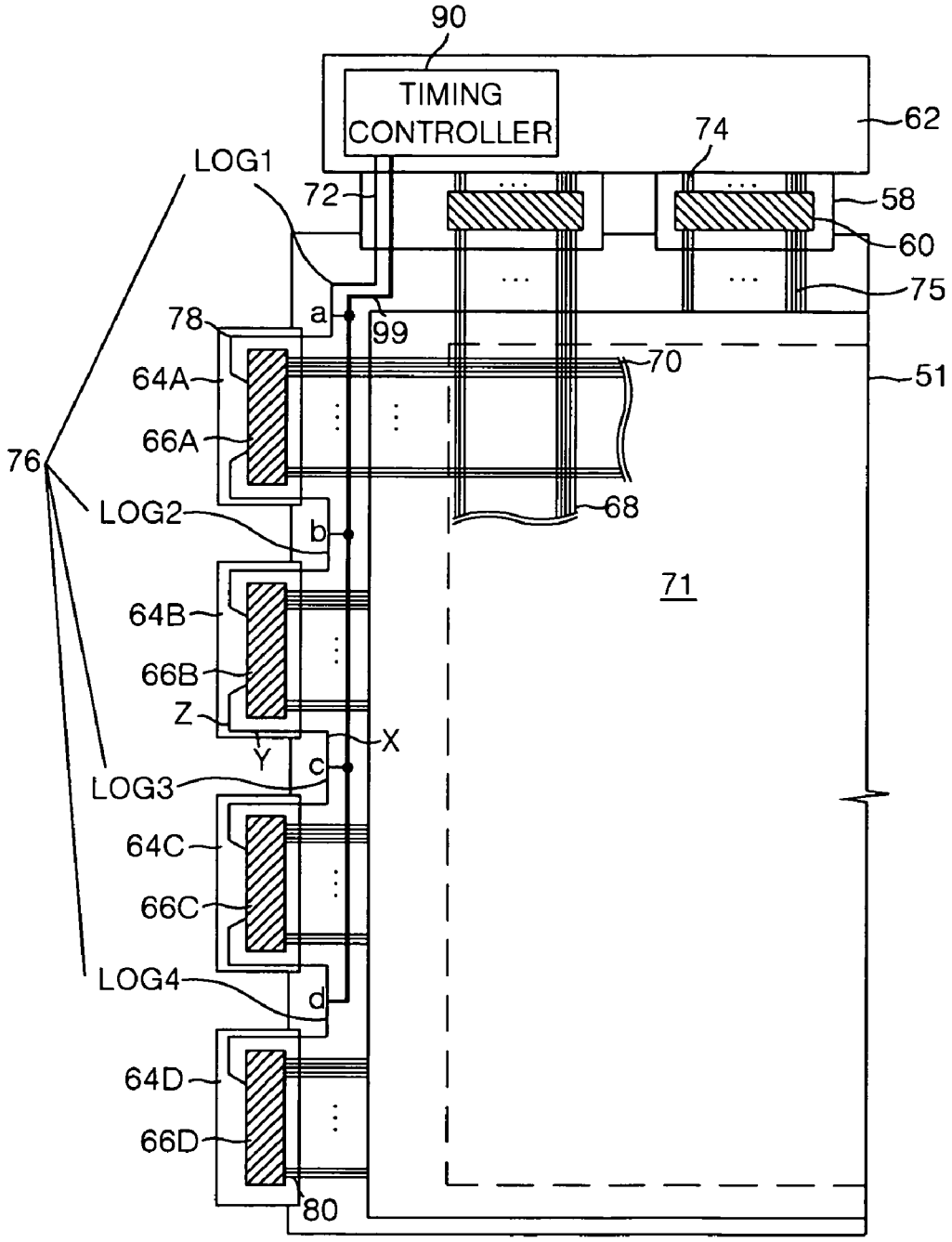
FIG. 3 is a schematic plan view showing a configuration of a liquid crystal display device.

FIG. 3 is a schematic plan view showing a configuration of an LOG-type liquid crystal display device. Referring to FIG. 3, the liquid crystal display device includes a liquid crystal display panel 51, a plurality of data TCPs 58 and a data PCB 62. The plurality of data TCPs 58 are connected between the liquid crystal display panel 51 and the data PCB 62. The liquid crystal display device further includes a plurality of gate TCPs 64A to 64D, a data drive ICs 60 and gate drive ICs 66A~66D, a LOG-type signal line group 76 and an inspection line 99. The plurality of gate TCPs 64A~64D are connected to other side of the liquid crystal display panel 51. The data drive ICs 60 are mounted on the data TCPs 58, and the gate drive ICs 66A to 66D are mounted on the respective gate TCPs 64A to 64D. The LOG-type signal line group 76 applies signals from a timing controller 90 to the gate drive ICs 66A to 66D, and the inspection line 99 scans a voltage value supplied through the LOG-type signal line group 76.

Figure 4:
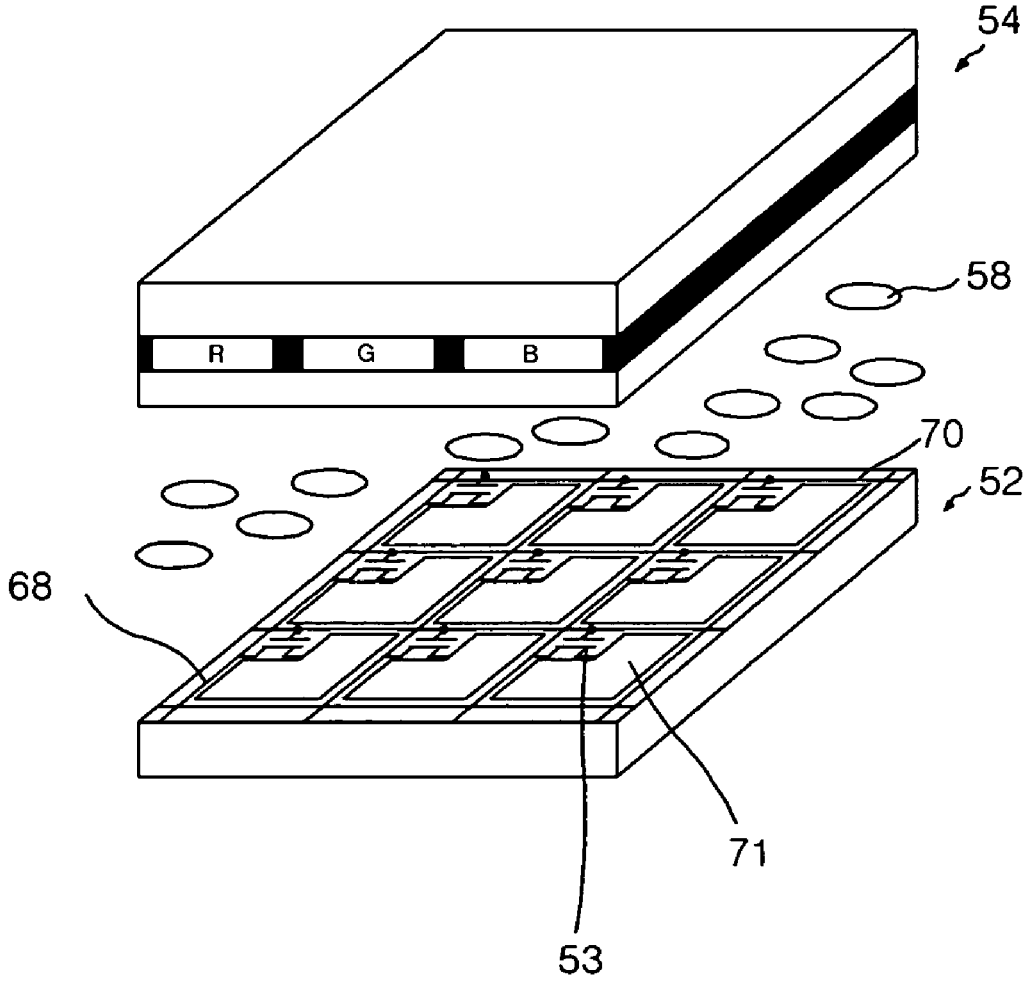
FIG. 4 illustrates a liquid crystal display panel including the liquid crystal display device of FIG. 3.

As shown in FIG. 4, a lower substrate 52 includes various signal lines and a thin film transistor array 53. An upper substrate 54 includes a color filter array and a liquid crystal is injected between the lower substrate 52 and the upper substrate 54. The liquid crystal display panel 51 displays a picture on a picture display area 71 with liquid crystal cells provided at intersections between gate lines 70 and data lines 68. Referring back to FIG. 3, at the periphery of the lower substrate 52 and at the outer side of the picture display area 71, data pads extended from the data lines 68 and gate pads extended from the gate lines 70 are positioned. Further, the LOG-type signal line group 76 and the inspection line 99 are positioned at the outer area of the lower substrate 52. The LOG-type signal line group 76 transfers gate driving signals to gate drive ICs 66A to 66D and the inspection line 99 operates to inspect a voltage applied to the LOG-type signal line group 76.

In FIG. 3, the data drive IC 60 is mounted on the data TCP 58. The data TCP 58 is connected to output pads 74 of the data PCB 62 and data pads of the lower substrate 52 via input and output pads. In particular, the first data TCP 58 further includes a gate driving signal transmission line group 72 connected to the LOG-type signal line group 76 on the lower substrate 52. The gate driving signal transmission line group 72 applies the gate driving signals from the timing controller 90, via the data PCB 62, to the LOG-type signal line group 76.

The data drive ICs 60 convert digital pixel data signals into analog pixel voltage signals to apply them to the data lines 68 on the liquid crystal display panel 51. The gate drive ICs 66A to 66D are mounted on the gate TCPs 64A to 64D. The gate drive ICs 66A to 66D are connected to the gate pads of the lower substrate 52, via output pads connected to the gate drive ICs 66A to 66D. The gate TCPs 64A to 64D further includes a gate driving signal transmission line group 78 connected between the LOG-type signal line group 76 on the lower substrate 52 and the gate drive ICs 66A to 66D.

The gate drive ICs 66A to 66D sequentially apply a scanning signal, that is, a gate high voltage signal VGH to the gate lines in response to input control signals. Further, the gate drive ICs 66A to 66D apply a gate low voltage signal VGL to the gate lines 70 in the remaining interval after supplying the gate high voltage signal VGH.

The LOG-type signal line group 76 includes signal lines that supply direct current voltage signals from the power supply, such as a gate high voltage signal VGH, a gate low voltage signal VGL, a common voltage signal VCOM, a ground voltage signal GND and a supply voltage signal VCC. The LOG-type signal line group 76 also includes signal lines that supply gate control signals from the timing controller, such as a gate start pulse GSP, a gate shift clock signal GSC and a gate enable signal GOE. The LOG-type signal line group 76 is formed from a gate metal disposed adjacent the gate lines 70. The LOG-type signal line group 76 includes a predetermined resistance component X. Further, the ACF (not shown) includes a predetermined connection resistance component Y. The ACF connects signal lines on the lower substrate 52 to the input/output pads. Moreover, the lines provided on the TCP or the chip on film (COF) includes a predetermined line resistance component Z. The resistance components X, Y and Z are in proportion to the line length such that resistance values increase as signal lines longitudinally extend away from the data PCB 62. The increased resistance value may reduce a common voltage Vcom The inspection line 99 measures voltage values of direct current voltage signals supplied from the power supply, such as a gate high voltage signal VGH, a gate low voltage signal VGL, a common voltage signal VCOM, a ground voltage signal GND and a supply voltage signal VCC. The inspection line 99 also measures voltage values of gate control signals supplied from the timing controller, such as a gate start pulse GSP, a gate shift clock signal GSC and a gate enable signal GOE.

A method of driving the LOG-type liquid crystal display will be described. The LOG-type signal line group 76 supplies the common voltage VCOM. The LOG-type signal line group 76 includes first to fourth LOG-type signal line groups connected between the first data TCP 58 and the gate TCPs 64A to 64D. The LOG-type signal line group 76 has resistance values a, b, c and d proportional to line lengths thereof and are connected in series via the first to fourth gate TCPs 64A to 64D, respectively. The common voltage VCOM is supplied to each gate drive IC 66A-66D. The common voltage VCOM may change as the resistance value a, b, c and d changes along the line length. The inspection line 99 operates to inspect voltage values of the LOG-type signal line group 76 connected to the gate drive ICs 66A to 66D. Any difference in the common voltage VCOM may be detected with the inspection line 99.

More specifically, the first to fourth LOG-type signal lines LOG1 to LOG4 are connected to the inspection line 99. The inspection line 99 transfers to the timing controller 90 a voltage value and a ripple shape of the common voltage VCOM supplied over the LOG-type signal lines LOG1 to LOG4.

The timing controller 90 calculates an average value using the value of the common voltage VCOM of the LOG-type signal line group 76 supplied from the inspection line 99. Then, the timing controller 90 applies a phase-inverted average common voltage "−VCOM" to the LOG-type signal line group 76 using the calculated average common voltage value. A first common voltage VCOM1 supplied to the first LOG-type signal line LOG1 is attenuated by the line resistance of the first LOG-type signal line LOG1. Such attenuation may cause a linear distortion by the ripple. Likewise, the second common voltage VCOM2 supplied to the second LOG-type signal line LOG2 has a second common voltage VCOM2, which also may be distorted by the line resistances a+b of the first and second LOG-type signal lines LOG1 and LOG2. Third and fourth common voltages VCOM3 and VCOM4 also may be changed with the line resistances a+b+c and a+b+c+d, respectively. When each common voltage VCOM1, VCOM2, VCOM3 or VCOM4 is compared with one other, the fourth common voltage VCOM4 shows more serious distortion than the first common voltage VCOM1. This is because the line resistance is proportional to the length thereof. In the liquid crystal display device 300, all of the common voltages VCOM1 to VCOM4 are inspected to obtain their average value at the timing controller 90. Based on the average value, if the same common voltage VCOM is supplied to each LOG-type signal line group 76, the first to fourth common voltages VCOM1 to VCOM4 are equal to the VCOM.

The common voltages VCOM applied to the input terminals of the gate drive ICs 66A to 66D may be uniform. The uniform common voltage to the gate drive ICs 66A~66D may compensate for the resistance difference along the lengths of the LOG- type signal line group 76. The same voltage may be applied to the input terminals of the gate drive ICs 66A to 66D without any influence of the resistances. A brightness difference among the horizontal line blocks A to D may be prevented and a picture quality may substantially improve. In this embodiment, the inspection line 99 of the LOG-type LCD is used with the gate drive ICs. Alternatively, or additionally, the inspection line 99 may be used with the data drive IC 60.

The inspection line may inspect and compensate the voltage difference for each signal of the LOG-type signal line group 76 to reduce a brightness deviation. Furthermore, the inspection line 99 and the timing controller 90 of the LOG-type LCD control the drive ICs such that the same common voltage VCOM is provided. This common voltage is generated in a real time and reflects each picture. The picture may be a still picture and/or a moving picture having a lot of variation and changes. Accordingly, the LOG-type LCD may substantially reduce a cross talk phenomenon, a non-uniformity of a brightness and a Greenish phenomenon.

Although the invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device, comprising:

a plurality of integrated circuits for driving a liquid crystal display panel;

a first signal line supplying the integrated circuits with a first driving signal, wherein the first signal line includes a plurality of LOG (Line On Glass)-type signal lines which are connected to the others in series through the integrated circuits;

a second signal line detecting values of second driving signals generated from the LOG-type signal lines, wherein the second driving signals are generated by the first driving signal; and a signal generator calculating an average value of the second driving signals detected by the second line to produce a compensation signal, wherein the signal generator provides the first signal line with the compensation signal.

2. The liquid crystal display device according to claim 1, wherein the signal generator computes an average value of at least one of magnitudes and shapes of the second driving signals.

3. The liquid crystal display device according to claim 1, further comprising a liquid crystal panel comprising gate lines and data lines, wherein the integrated circuits comprise a plurality of gate integrated circuits for driving the gate lines and a plurality of data integrated circuits for driving the data lines.

4. The liquid crystal display device according to claim 3, wherein the gate integrated circuits receive a gate power signal and a plurality of gate control signals via the first signal line.

5. The liquid crystal display device according to claim 4, wherein the gate control signals comprise a gate start pulse GSP, a gate shift clock signal GSC and a gate enable signal GOE.

6. The liquid crystal display device according to claim 4, wherein the gate power signal comprises a common voltage.

7. The liquid crystal display device according to claim 1, further comprising a liquid crystal panel displaying a picture, wherein the integrated circuits comprise a plurality of driving circuits and the second signal line is disposed between the liquid crystal panel and the plurality of the driving circuits.

8. The liquid crystal panel device according to claim 1, wherein the first signal line and the second signal line extend parallel to each other and the second signal line is coupled to the first signal line with an extension for detecting the values of the second driving signals.

9. The liquid crystal panel device according to claim 1, further comprising a liquid crystal panel wherein the compensation signal operates to produce a common voltage having a single value and the common voltage is applied to the liquid crystal panel.

10. The liquid crystal panel device according to claim 1, wherein the signal generator compares a plurality of common voltages and determines a difference in the plurality of common voltages.

11. The liquid crystal display device according to claim 10, wherein upon detection of the difference, the signal generator operates to adjust the plurality of common voltages to have the identical voltage.

12. A method for driving a liquid crystal display device, comprising:

applying a first driving signal, via a signal line, to a plurality of integrated circuits, wherein the signal line includes a plurality of LOG (Line On Glass)-type signal lines which are connected to the others in series through the integrated circuits;

detecting values of second driving signals generated from the LOG-type signal lines with an inspection line, wherein the second driving signals are generated by the first driving signal;

transferring the detected values of the second driving signals to a controller;

at the controller, calculating an average value of the second driving signals detected by the inspection line to produce a compensation signal, wherein the controller provides the first signal line with the compensation signal; and applying the compensation signal to a liquid crystal panel via the signal line.

13. The method according to claim 12, wherein detecting the values of the second driving signals comprises measuring a voltage value of a voltage signal from a power supply.

14. The method according to claim 12, wherein applying the first driving signal comprising applying at least one of a gate power signal and a gate control signal to a gate line of the liquid crystal display panel.

15. The method according to claim 14, wherein applying the gate power signal comprises applying a common voltage to the gate line of the liquid crystal display panel.

16. The method according to claim 12, wherein calculating an average value of the second driving signals comprises computing an average value of any least one of magnitudes and shapes of the second driving signal.

* * * * *